United States Patent [19]

Noble et al.

[11] Patent Number: 4,842,574

[45] Date of Patent: Jun. 27, 1989

[54] BUCKLE CHUTE FOLDER HAVING SHEET SQUARING FEATURE

[76] Inventors: Noel L. Noble, 23313 Melville, Hazel Park, Mich. 48030; Edward A. Bluthardt, 6478 Canmoore, Troy, Mich. 48098; Jeffrey L. Goins, 55605 Card Rd., New Haven, Mich. 48048

[21] Appl. No.: 76,129

[22] Filed: Jul. 21, 1987

[51] Int. Cl.[4] ..... B65H 45/14

[52] U.S. Cl. ..... 493/421; 493/417; 493/461; 493/468; 493/476; 271/236; 271/240; 271/245; 271/246; 271/250

[58] Field of Search ..... 493/417, 419, 420, 421, 493/460, 461, 468, 476; 271/236, 240, 245, 246, 250, 251

[56] References Cited

U.S. PATENT DOCUMENTS

| | | | |
|---|---|---|---|
| 1,275,425 | 8/1918 | Hitchcock | 493/420 |
| 2,186,901 | 1/1940 | Ewald et al. | 493/417 |
| 2,757,927 | 8/1956 | Bach et al. | 493/421 |
| 3,416,785 | 12/1968 | Sherman | 493/420 |
| 3,495,818 | 2/1970 | Marin | 493/420 |
| 3,738,643 | 6/1973 | Bell et al. | 271/246 |
| 4,245,831 | 1/1981 | Michatek | 271/240 |
| 4,573,672 | 3/1986 | Lehmann et al. | 493/420 |
| 4,619,101 | 10/1986 | Havey et al. | 493/421 |

*Primary Examiner*—Frederick R. Schmidt
*Assistant Examiner*—William E. Terrell
*Attorney, Agent, or Firm*—John R. Benefiel

[57] ABSTRACT

A table top buckle chute fold machine is disclosed in which improved and more reliable squaring of the paper to the folding rolls is accomplished by lightly driving an inserted sheet of paper with a friction roller against a selected one of several deflector assemblies. The deflector assemblies each include a deflector member spaced away from the rollers to direct the advancing edge of the paper inwardly so as to be abutted against the back of a recessed guide groove. An intermittently engaged drive roller causes the squared paper to be forcibly advanced against the groove, causing the sheet to buckle and be nipped between another pair of driven nip rollers, forming a first fold at the location determined by the location of the particular deflector assembly activated. A movable deflector back either routes the folded paper to an exit chute or to another abutment surface, causing buckling and nipping between another pair of nip rollers to optionally add a second fold to the already folded sheet of paper prior to exiting the machine.

15 Claims, 6 Drawing Sheets

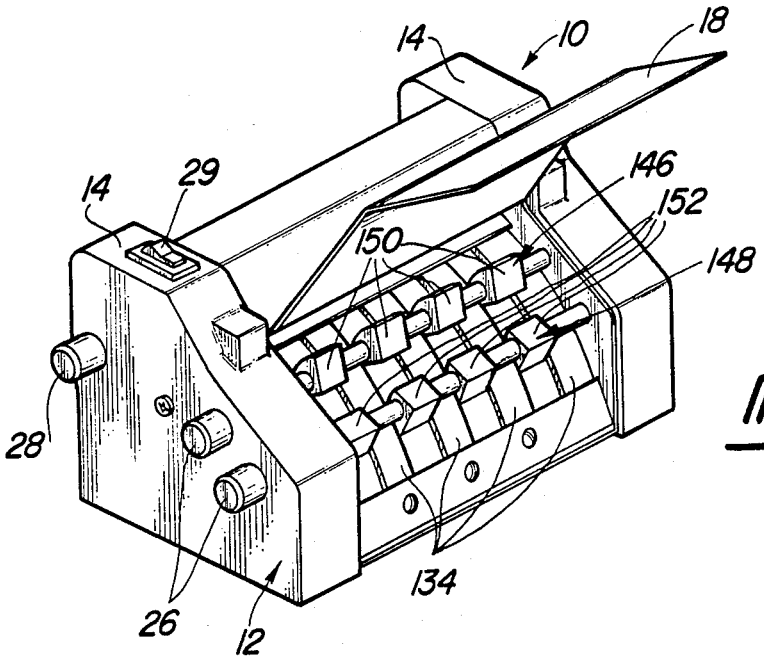
Fig-2A
Fig-3
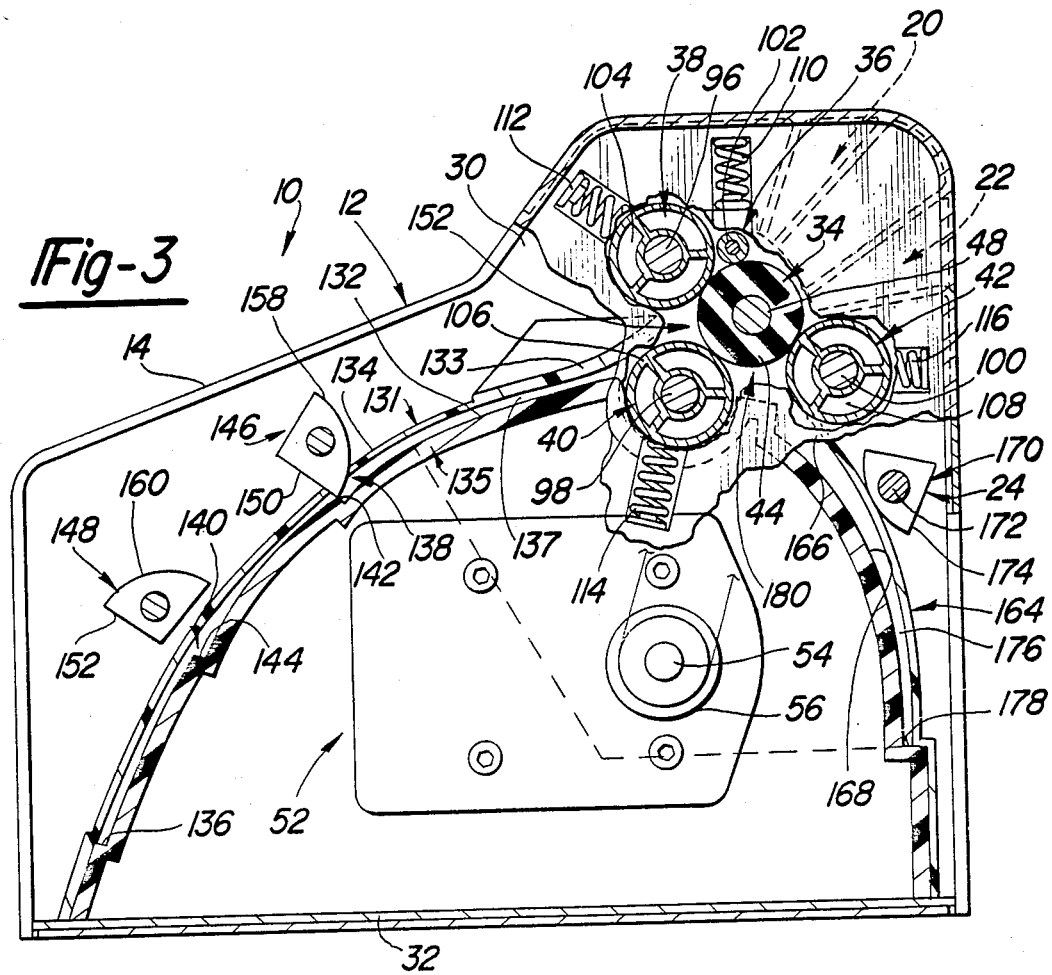

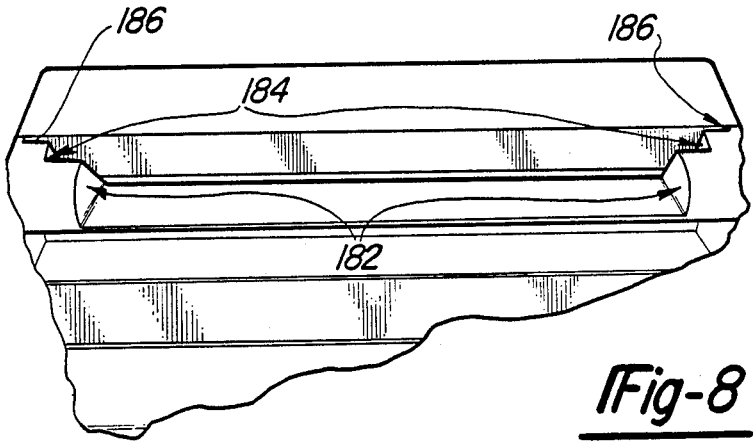
Fig-8
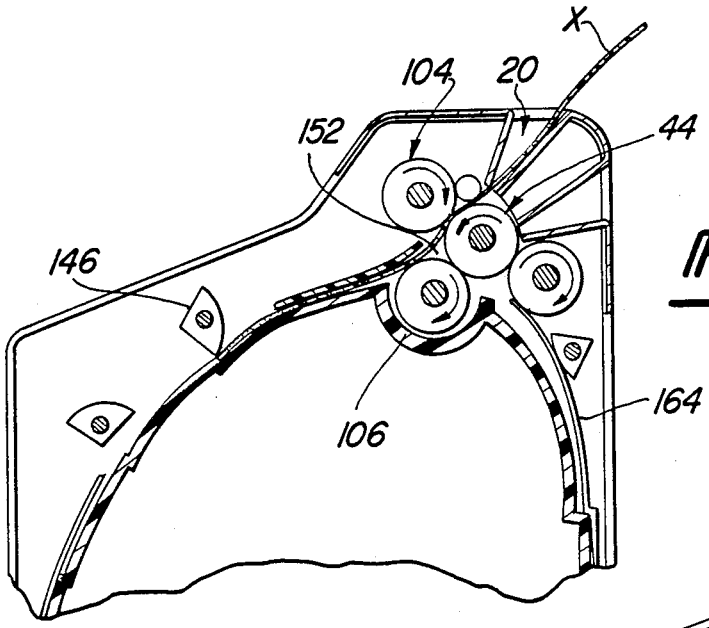
Fig-9A
Fig-9B
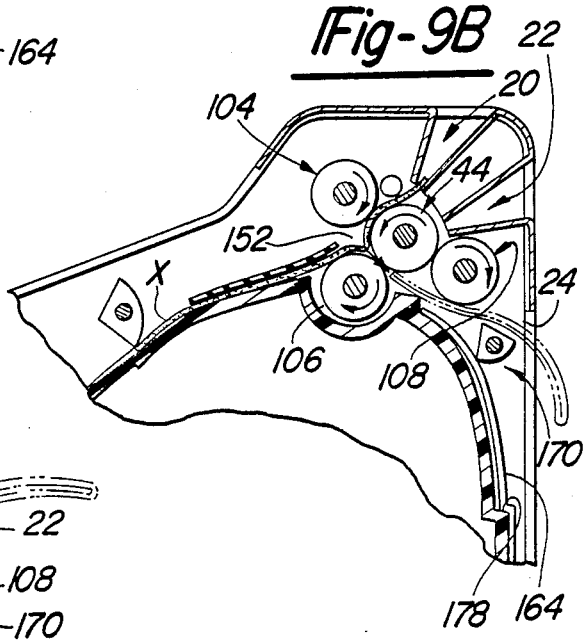
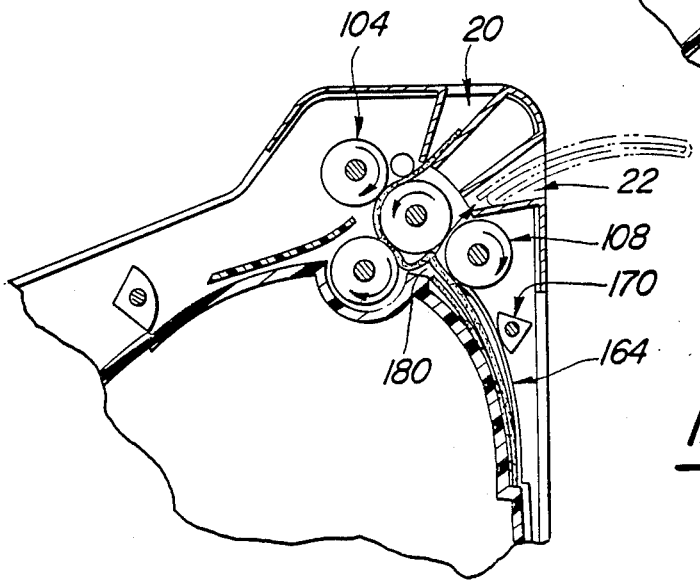
Fig-9C

BUCKLE CHUTE FOLDER HAVING SHEET SQUARING FEATURE

BACKGROUND OF THE INVENTION

The present invention relates to sheet folding machines of the very well known "buckle fold" type, in which a sheet of paper is advanced against a stop to cause buckling of the paper, with the buckle drawn between a pair of strategically located nip rollers to form a fold across the width of the paper sheet.

The reliability of such machines depends in large part on the incidence of skewing of the paper sheet with respect to the rollers as it is fed into the machines, particularly for one-at-a-time manual feed.

Such machines often include movable stops to enable different fold line locations to be achieved and also to allow selective control over the number of folds. Such movable stops do not define locating surfaces which are accurately squared to the direction of paper feed, precisely repeatable fold patterns are thus not ensured for machines having such adjustable fold pattern capability.

Versatility in accommodating various paper widths and fold patterns is of great usefulness, particularly if it can be achieved by a simple desk top machine. Manual squaring of the paper is usually required as it is fed, sometimes leading to inadvertent misalignment and less reliability in the folding action is thereby created.

SUMMARY OF THE INVENTION

The present invention is a buckle fold machine in which the inserted sheet is driven to be advanced into the machine by a friction drive which only lightly engages the sheet to allow lateral movement to create a self-squaring action of the sheet as it is urged against one or more squaring surfaces, contacting either the sides and/or the leading edges of the inserted sheet.

A folding feed roller is intermittently shifted into engagement with the inserted sheet by a cam and cam follower to enable the self squaring action to take place.

Adjustable stops are provided by a combination of movable deflectors and intermediate recessed grooves accurately formed into a table surface over which the paper is advanced, to selectively cause the leading edge of the sheet to be deflected into one of the recesses, or to pass to elevated, accurately formed stop surface, bypassing the intermediate recessed grooves.

Advance to a secondary stop surface is also selectively controlled by a movable deflector, which either routes a folded sheet out of the machine, or into contact with the secondary stop, causing buckling and folding by a second set of nip rollers, to selectively allow either one or two folds to be executed on an inserted sheet.

A main drive roller is powered by an electric motor, and geared to a feed, and first and second nip rollers are arrayed about the main roller to each form an opposed roller set with the main drive roller. The main drive roller being geared to the other rollers causes synchronous rotation of each of the other rollers. The other rollers are arrayed about the main drive roller respectively to form a feed roller set and first and second nip roller sets in combination with the main drive roller.

An auxiliary roller is also provided which is, not gear driven but which is biased into engagement with the main drive roller to establish a light, squaring frictionally driven advance of an inserted sheet. The auxiliary roller exerts only a light pressure against the sheet, allowing lateral shifting of the inserted sheet and enabling a selfsquaring action to take place.

The inserted sheet immediately passes between the main drive roller and the feed roller after passing the auxiliary roller, but a camming arrangement forces the feed roller out of contact with the sheet except for a short time period, when the squared sheet is forcefully driven against the stop to cause buckling. This allows the squaring action to be accomplished prior to folding advance of the inserted sheet.

An infeed chute is provided with several sets of lateral surface, each acting as a squaring side surfaces for sheets of several predetermined widths.

DESCRIPTION OF THE DRAWINGS

FIG. 2A is a perspective view of the rear of the machine shown in FIG. 2 with the rear cover pivoted open.

FIG. 3 is a fragmentary transverse sectional view of the machine shown in FIGS. 1 and 2 showing the rollers and guide surfaces for an inserted sheet.

FIG. 8 is a fragmentary front perspective view of modified multiwidth entrance chute, accommodating a variety of paper widths.

FIGS. 9A through 9C are transverse sectional fragmentary views of the folding machine illustrating the various sheet folding operations.

DETAILED DESCRIPTION

In the following specification a particular embodiment is described in accordance with the requirements of 35 USC 112 and specific terminology used for the sake of clarity, but this should not be construed as being limiting, inasmuch as the invention is capable of taking many forms and variations within the scope of the appended claims.

Figure 1:
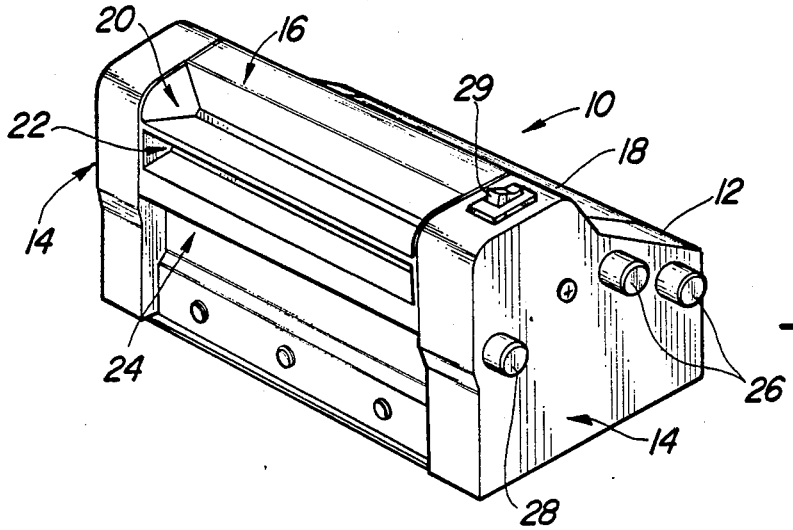
FIG. 1 is a perspective view of the front or feed side of a sheet folding machine according to the present invention.
Figure 1A:
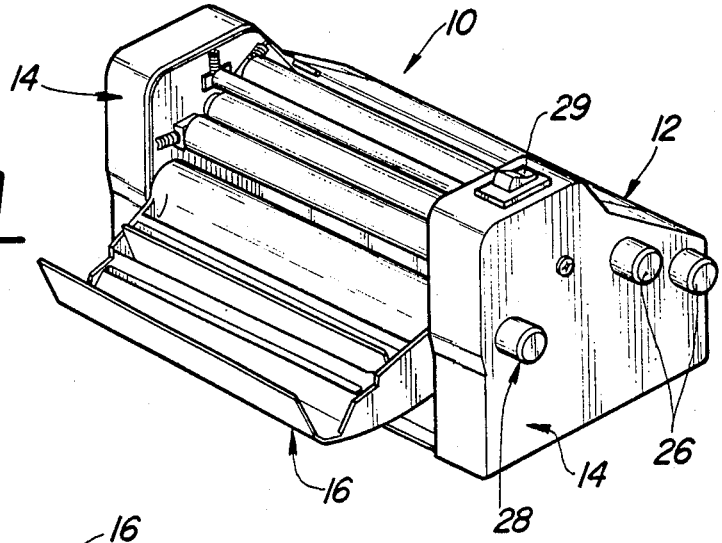
FIG. 1A is a perspective view of the front of the machine shown in FIG. 1 with the chute housing piece pivoted open.
Figure 2:
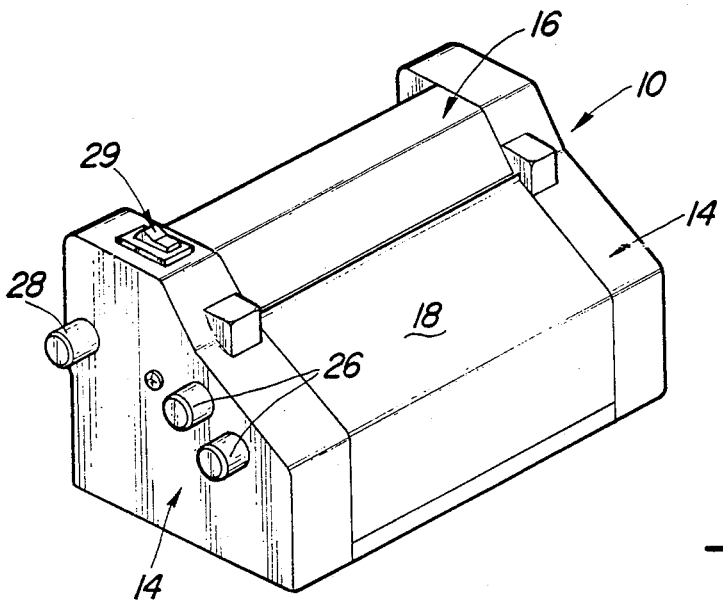
FIG. 2 is a perspective view of the rear of the machine shown in FIG. 1.

Referring to FIGS. 1 and 2, the sheet folding machine 10 according to the present invention is a compact, desk top apparatus including a housing 12 defined in part by molded plastic end pieces 14 affixed on either side of a housing chute piece 16 occupying the top and rear portions of the machines. An angled rear cover 18 overlies the central rear portion of the machine 10. Chute piece 16 and rear cover 18 are pivotable to be opened to allow access to free jam conditions.

An entrance chute 20 is defined in the chute piece 16, formed into the upper most surface, and into which is inserted one at a time the sheets to be folded.

A pair of exit chutes are provided, upper exit chute 22 and lower exit chute 24, upper exit chute 22 passing out a double folded sheet, lower exit chute 24 passing out single folded sheets as will be described hereinafter.

Fold location control knobs 26 are provided on one side of the machine, which are selectively operable to set the fold locations at any of three progressively advanced positions, as will be described in detail hereinafter.

A double fold control knob 28 is also provided, selectively openable to cause a second fold to be executed on an inserted sheet, described further herein.

An on-off control switch 29 is also provided atop the right hand side plate 14.

By reference to FIG. 3, the operating internal components may be understood.

A series of parallel roller assemblies 34, 36, 38, 40 and 42, are rotatably mounted between parallel side plates 30 fixed to a bottom plate 32, together forming the structural framework for the machine 10.

This includes a main drive roller assembly 34, an idler feed roller assembly 36, a powered feed roller assembly 38, a first nip assembly 40 and a second nip roller assembly 42.

Figure 6:
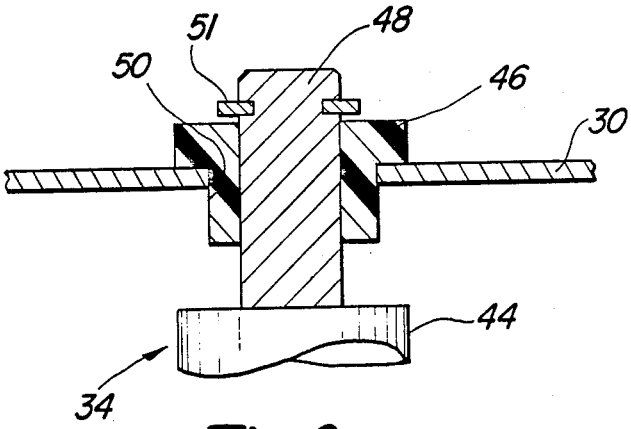
FIG. 6 is a fragmentary horizontal sectional view through an end of a roller, illustrating the slide bearing mount therefor.

Main drive roller assembly 34 comprises a rubber roller 44 mounted for rotation about a fixed axis by means of axle shaft 48 received in plain bushings 46 constructed of a suitable bearing material such as Delrin (TM) plastic received in aligned bores 50 in either side plate 30 and secured by a snap retainer 51 (FIGURE 6).

The main drive roller assembly 34 is driven by power means including an electric motor 52 mounted within housing 12, having an output shaft 54 fixed to a pulley 56.

Pulley 56 drives a belt 58, which in turn drives a pulley 60 affixed to one end of axle shaft 48 of main drive roller assembly 34 to rotate the same.

Figure 3A:
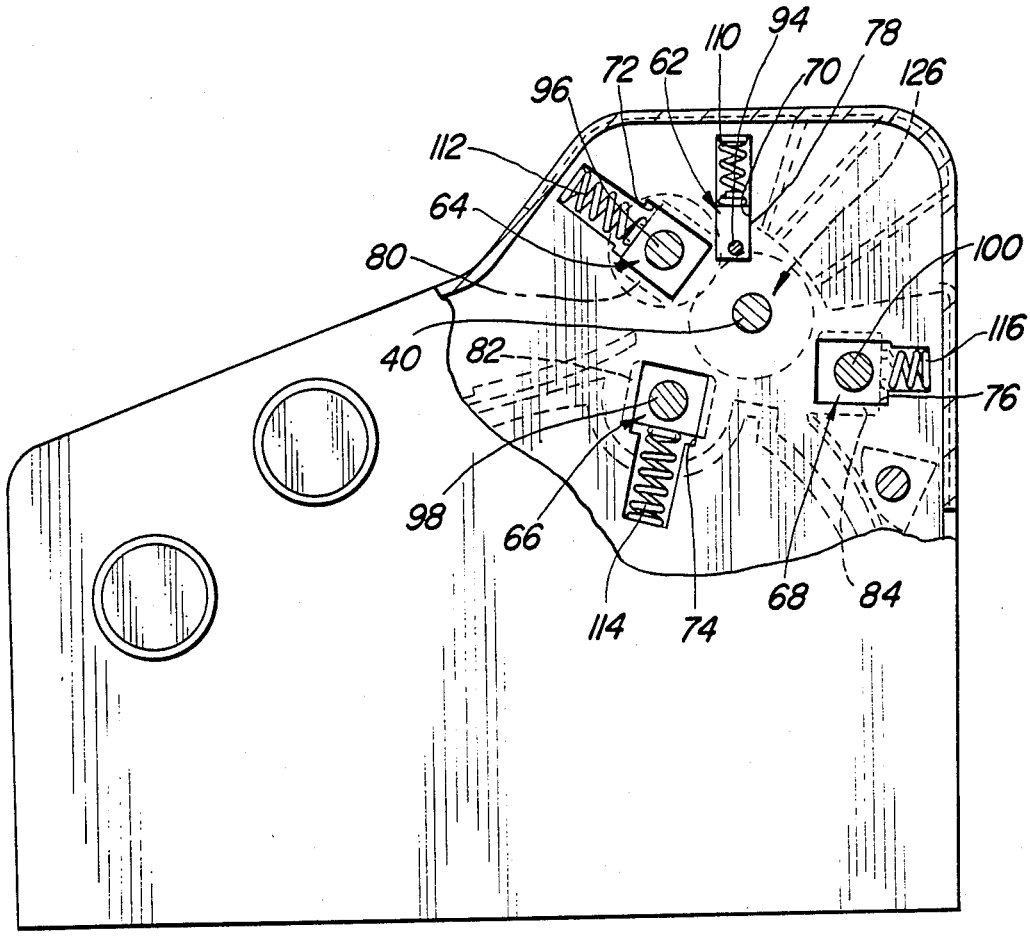
FIG. 3A is a partially sectional end view of the machine shown in FIGS. 1–3.

As best seen in FIG. 3A, each of the remaining roller assemblies 36–42 are mounted for rotation about floating axes of rotation by means of pairs of Delrin (TM) plastic square bushings 62, 64, 66 and 68, received in respective slots 70, 72, 74 and 76 formed in side plates 30. Each square bushing 62–68 is formed with a linear flange 78, 80, 82 and 84 bearing against the surfaces adjacent the slots 70–76 and with a through bore 86–92 receiving one end of an axle shaft 94, 96, 98 and 100 mounting aluminum rollers 102, 104, 106 and 108 of roller assemblies 36–42 respectively (FIG. 3).

Each roller assembly 36–92 is urged towards the main drive roller 44 by compression springs 110, 112, 114 and 116 respectively, each received in respective slots 70–76 (FIG. 3A).

Figure 4:
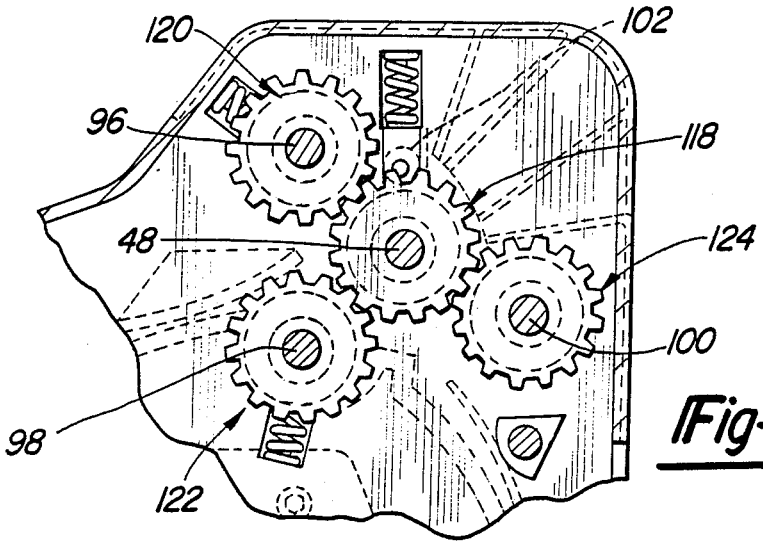
FIG. 4 is a fragmentary transverse sectional view of the machine shown in FIGS. 1 and 2 showing the gearing related to the rollers shown in FIG. 3.

Feed roller assembly 38, first nip roller assembly 40 and second nip roller assembly 42 are each drivingly connected to the main drive roller assembly 34 so as to be rotated in synchronism therewith by gearing means shown in FIG. 4. The gearing means include gear 118 affixed to one end of axle shaft 48 of main drive roller assembly 34, gear 120 in mesh therewith affixed to one end of axle shaft 96 of feed roller assembly 38, gear 122 in mesh with gear 118, affixed to one end of axle shaft 98 of first nip roller assembly 40; and gear 124, also in mesh with gear 118, affixed to one end of axle shaft 100 of second nip roller assembly 42.

The roller 102 of idler feed roller assembly 36 is not driven but engages an inserted sheet to generate friction with the rotating rubber roller 44, causing a light advancing drive force to be applied to a sheet inserted into entrance chute 20. This advancing force causes a squaring action by engagement of the sides of an inserted sheet with the side surfaces of the entrance chute 20.

Figure 7:
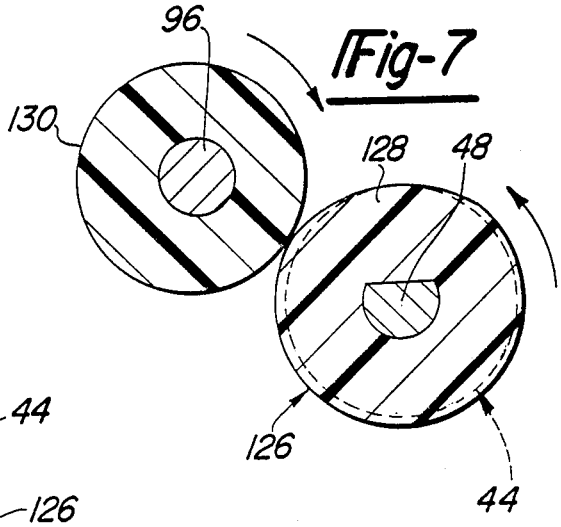
FIGS. 7A and 7B are sectional views taken through the main drive cam and feed roller cam follower, with the cam and cam follower in the engaged and disengaged conditions respectively.
Figure 7A:
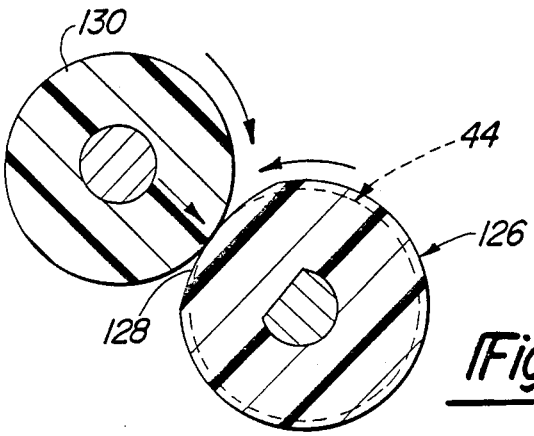
Figure 5:
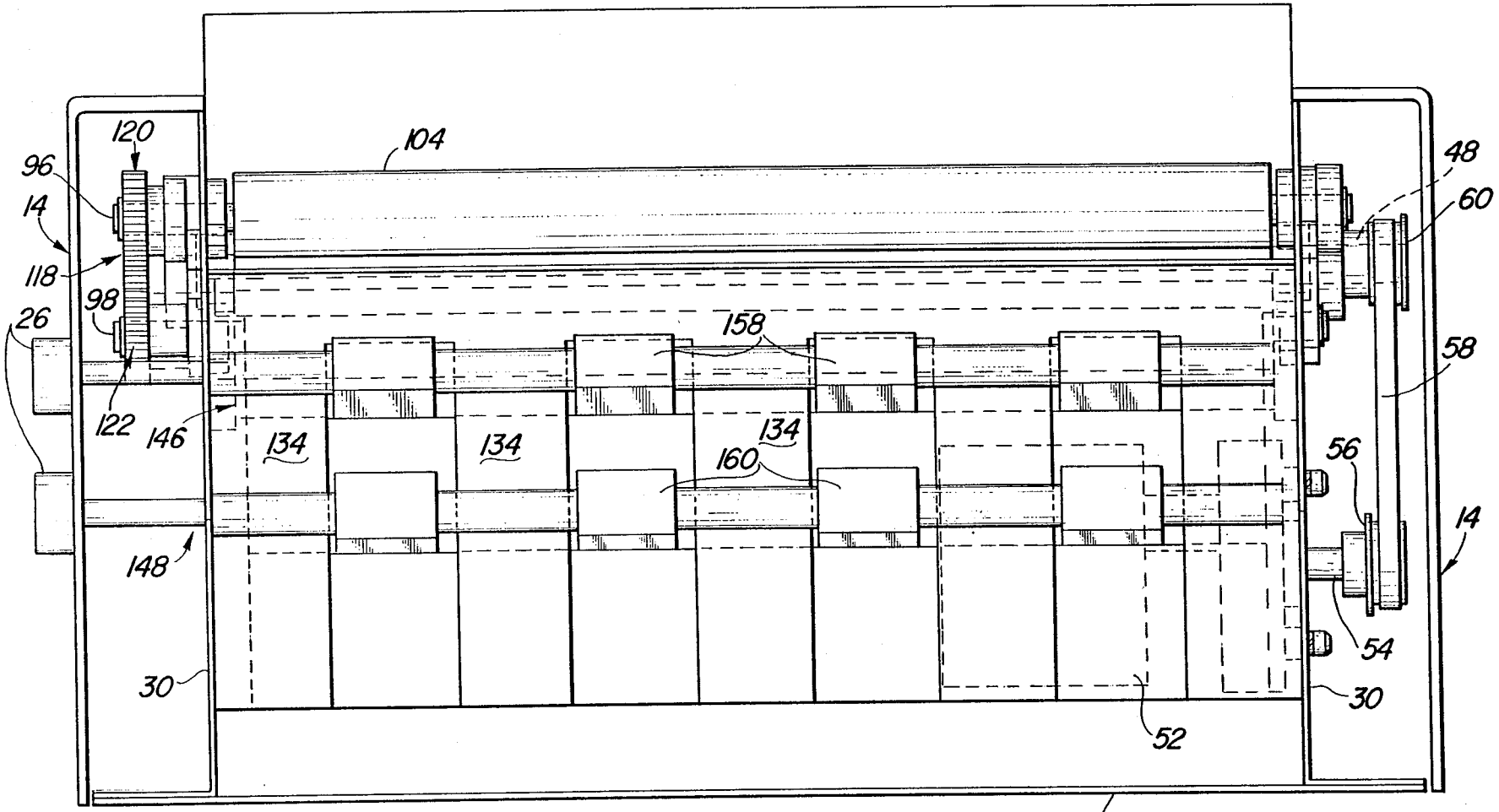
FIG. 5 is a rear elevational view of the machine shown in FIGS. 1 and 2 with the rear cover removed.

An inserted sheet is thereafter advanced between feed roller 104 and main drive roller 44. The position of feed roller 104 is controlled by cam means so that the inserted sheet is gripped to be driven thereby only intermittently, to allow nondriving time intervals to accommodate lateral squaring movement of the inserted sheet while out of engagement of the feed roller 104 and main drive roller 44. Referring to FIGS. 7 and 7A, the cam means includes a roller cam 126 affixed to either end of the main roller assembly axle shaft 48, of a larger diameter than the main roller 44 but having a localized flattened region 128. The cam 126 is engaged with a respective one of a pair of cam followers 130 affixed to the opposite ends of axle shaft 96 of the feed roller assembly 38.

Cam followers 130 are of the same diameter as roller 104 so that as long as contact is with the full diameter of cam 126, roller 104 is held away from contact with rubber roller 44 and is disengaged from an inserted sheet of paper. The gears 118 and 120 have a sufficient range of gear mesh to maintain driving engagement of cam 126 in this condition.

When the flattened portion 128 rotates around to engage the cam follower 130, this allows the roller 104 to radially move in sufficiently to engage the rubber roller 44 to establish driving engagement with an inserted sheet, as indicated in FIG. 7A.

Referring again to FIG. 3, an inserted sheet advances over a curved table surface 132 after being passed between the idle feed roller pair comprised of idle feed roller 102 and main drive roller 44 and between the buckle feed roller pair comprised of rollers 104 and 44. Table surface 132 is provided by a curved molded plastic member 135 fixed between side plates 30.

A cage 131 is provided mounted over member 135, having an entrance guide 133 directing an inserted sheet between a series of laterally spaced cage leaves 134 overlying the table surface 132, located thereabove a short distance to define a clearance space 137 to accommodate an inserted sheet. This arrangement confines the sheet to prevent buckling at any location other than the proper one to be described below.

A series of stop surfaces are provided located at spaced locations along the path of an advancing sheet.

A transversely extending end stop surface 136 is molded into member 135 to project above the surface 134 so as to lie in the path of advance of an inserted sheet and arrest further advance thereof.

A plurality of intermediate stop surfaces are also provided, each formed by grooves 138 and 140 recessed below the surface 132, and each having an end wall 142, 144 extending transversely to the path of advance of an inserted sheet.

A pair of deflector assemblies 146, 148 are provided extending along a respective intermediate groove 138 and 140, connected to a respective one of control knobs 26 to be able to be manually rotated.

Each deflector 146, 148 includes a series of deflectors 150, 152 mounted to a pivotable deflector shaft 154, 156. Each deflector 146, 148 has a curved surface 158, 160 movable from a position out of clearance space 137 into a position in said clearance space just ahead of a respective groove 138 and 140 so as to guide an advancing sheet against intermediate stop surface 142 or 144. A suitable detent (not shown) secures the deflector shaft in either position.

The self-squaring action described may also be achieved by movement of the inserted sheet against one of the stop surfaces 136, 142 or 144.

As shown in FIGS. 9A and 9B, upon engagement of the feed roller 104, the sheet x, upon being deflected against stop 142 by deflector 146, is caused to buckle in the region 152 at the convergence of the peripheries of main drive roller 44 and first nip roller 106, which buckle is drawn therebetween, causing the sheet x to be folded, and the folded sheet to be advanced out the other side thereof.

A movable deflector panel 164 (FIG. 3) is fastened to molded member 135 along the lower edge, and has a chamfered leading edge 166 positioned either against second nip roller 108, or against rear table surface 168 of member 135. This position is controlled by a rear deflector assembly 170, comprised of pivotal shaft 172 attached to knob 28 and a pair of deflectors 174. Deflectors 174 are selectively movable by knob 28 and shaft 172 to force the deflector panel 164 against surface 168, and the once folded sheet thus exits the machines through lower exit chute 24.

Upon being released, deflector panel 164 springs out against second nip roller 106, guiding folded sheet into a confined space 176 (FIG. 9C). This causes advance of the folded sheet down against a rear stop surface 178. Contact of the leading edge of the folded sheet causing buckling in the region 180, the buckle is forced into the convergency between main drive roller 44 and second nip roller 108, where it is drawn between these rollers to again be folded, and pass out of the upper exit chute 22.

The entrance chute 20 may be configured with several sets of lateral squaring surfaces as shown in FIG. 8, an inner set 182, intermediate set 184, and outer set 186. This allows various sheet widths to be accommodated.

Accordingly, it can be appreciated that the machine accomplishes the advantages described above, i.e. a highly reliable and accurate folding action by a simple configuration of parts.

Many variations of the specifics described are of course possible within the scope of the appended claims.

We claim:

1. A buckle fold machine of the type including a plurality of rollers mounted for rotation about axes parallel and adjacent to each other, means directing a leading edge of a sheet of paper introduced between a first set comprising a first pair of said rollers normally closely spaced to grip said sheet of paper, means driving said first set of rollers to be rotated to feed said introduced sheet; a stop surface extending parallel to said rotational axis of said first set of rollers located to be contacted by said leading edge of said sheet to be buckled thereagainst, said plurality of rollers including a second set of rollers comprising a closely spaced pair of said rollers, said buckle so formed drawn between said second set of said rollers to be folded, and drive means for rotating said second sets of rollers, the improvement comprising:

squaring means for squaring said piece of paper to said first set of rollers, including an auxiliary light frictional drive means separate from said first set of rollers, acting on said sheet of paper introduced between said set of said rollers, said frictional drive means allowing lateral squaring movement of said sheet of paper after contacting said stop, said stop surface contacting said leading edge of said sheet of paper advanced by said light frictional drive tending to square said sheet of paper thereagainst; and, cam means periodically separating said first set of rollers gripping said sheet of paper to allow lateral movement therebetween to accommodate said squaring movement of said sheet.

2. A buckle fold machine comprising:

a housing;

an elongated main drive roller mounted for rotation in said housing;

power means for rotating said main drive roller;

an idler roller mounted parallel to said main feed roller for free rotation and urged into light frictional engagement therewith to establish a frictional advance of a sheet of paper introduced therebetween;

a first feed roller mounted parallel and adjacent to said main and idler rollers;

means urging said feed roller towards said main feed roller;

drive means rotating said first feed roller in synchronism with said main drive roller;

cam means restraining movement of said feed roller so as to produce intermittent contact with said main drive roller;

at least one squaring surface defined by said housing tending to square a sheet of paper inserted between said drive roller and idler roller by frictional advance of the piece of paper;

a first nip roller mounted parallel and adjacent to said main drive roller;

means urging said nip roller into engagement with said main drive roller;

drive means rotating said nip roller in synchronism with said main drive roller;

primary stop surface means located to intercept said sheet of paper advanced by said feed roller and causing buckling thereof;

said nip roller and main drive roller located to draw said buckled piece of paper therebetween and produce a fold thereacross.

3. The buckle fold machine according to claim 2 wherein said cam means comprises a mating cam and a cam roller affixed to either end of said feed and main drive rollers.

4. The buckle fold machine according to claim 3 further including gearing means drivingly engaging each of said feed, main drive and first nip rollers to provide said drive means therefor, whereby said rollers are synchronously rotated thereby.

5. The buckle fold machine according to claim 2 further including a second nip roller mounted parallel and adjacent to said main drive roller, means urging said second nip roller into engagement with said drive roller, and drive means rotating said second nip roller in synchronism with said main roller; secondary stop surface means located to intercept a folded sheet of paper advanced out from between said main drive roller and said first nip roller and cause a buckling there, said second nip roller located to draw said buckled folded sheet of paper therein to produce a second fold.

6. The buckle fold machine according to claim 2 wherein said primary stop surface means includes at least one intermediate stop surface and an end stop surface, said at least one intermediate stop surface located ahead of said end stop surface and a corresponding deflector for each intermediate stop surface having a portion selectively positionable in the path of said inserted sheet of paper to guide the leading edge of said sheet of paper to move against a respective stop surface, and out of the path thereof to allow said paper to move past said intermediate stop surface.

7. The buckle fold machine according to claim 5 further including a selectively positionable deflector having a portion movable into the path of said folded sheet of paper to guide said folded sheet of paper into the secondary stop surface or alternatively to bypass said secondary stop surface and be discharged from said machine.

8. The buckle fold machine according to claim 2 wherein said housing includes an infeed chute having a pair of spaced lateral surfaces engageable with the sides of an inserted piece of paper comprising said at least one squaring surface.

9. The buckle fold machine according to claim 8 wherein said infeed chute is formed with a plurality of pairs of spaced lateral surfaces each engageable with the sides of inserted sheets of paper of varying width.

10. The buckle fold machine according to claim 8 wherein said stop surface also comprises a squaring surface.

11. The buckle fold machine according to claim 6 wherein said housing includes a table surface extending behind said main drive and feed rollers to receive thereover a piece of paper passing therebetween, said table surface formed with at least one transversely extending groove recessed thereinto comprising said at least one intermediate stop surface.

12. The buckle fold machine according to claim 11 wherein said housing further includes a cage structure comprising a series of spaced leaves extending over above said table surface with space therebetween to accommodate a sheet of paper driven therethrough and wherein said at least one deflector movable portion extends into the spaces between said leaves.

13. A buckle fold machine including a first pair of normally engaging opposed rollers; means for rotating said first pair of rollers to advance a leading edge of a sheet of paper inserted therebetween; at least one stop surface positioned to be approached by said inserted sheet to move against said at least one stop surface to thereby buckle said inserted piece of paper, a second pair of opposed rollers and drive means for rotating the same; said buckle forming to be drawn between said second pair of opposed rollers to fold said sheet of paper, the improvement comprising a table surface disposed to receive said inserted piece of paper from said first pair of rollers with at least one groove recessed into said table surface extending transversely to the path of said inserted sheet and extending parallel to said leading edge of said inserted sheet and located so that said inserted sheet is driven to the location of said groove; said at least one of said groove comprising said at least one stop surface and, at least one movable deflector means having a portion selectively movable into the path of said sheet of paper and located to deflect said leading edge into said at least one groove to cause said sheet of paper to be stopped by said groove and thereby buckled by continued advance caused by rotation of said first pair of rollers.

14. The buckle fold machine according to claim 13 wherein said table surface comprises a curved surface having a plurality of grooves recessed into said surface spaced apart along the path of said inserted sheet of paper, each of said grooves extending transversely to the path of said inserted sheet of paper and parallel to the leading edge of said inserted sheet, and, a corresponding plurality of deflector means, each associated with a respective one of said plurality of transverse grooves.

15. The buckle fold machine according to claim 14 further including a cage structure comprising spaced leaves overlying said table surface to define a space to receive and confine said paper therebetween in being advanced by said first pair of rollers, and wherein each of said plurality of deflector means has movable portions extending between said leaves into said paper space.

* * * * *

UNITED STATES PATENT AND TRADEMARK OFFICE

CERTIFICATE OF CORRECTION

PATENT NO. : 4,842,574

DATED : June 27, 1989

INVENTOR(S) : Noble et al

It is certified that error appears in the above-identified patent and that said Letters Patent is hereby corrected as shown below:

Column 1, line 47, after "to" (second occurrence) insert --an--.

Column 1, line 64, after "provided" insert --,--.

Column 1, line 64, after "is" (second occurrence) delete ",".

Column 5, line 63, "sets" should be --set--.

Column 6, line 58, after "said" insert --main--.

Signed and Sealed this

Fifteenth Day of May, 1990

*Attest:*

HARRY F. MANBECK, JR.

*Attesting Officer*

*Commissioner of Patents and Trademarks*